US007134309B2

(12) United States Patent
Toeniskoetter

(10) Patent No.: US 7,134,309 B2
(45) Date of Patent: Nov. 14, 2006

(54) PRE-HEMMING APPARATUS

(75) Inventor: James B. Toeniskoetter, Rochester Hills, MI (US)

(73) Assignee: TESCO Engineering, Inc., Auburn Hills, MI (US)

( * ) Notice: Subject to any disclaimer, the term of this patent is extended or adjusted under 35 U.S.C. 154(b) by 0 days.

(21) Appl. No.: 11/184,752

(22) Filed: Jul. 19, 2005

(65) Prior Publication Data

US 2006/0179910 A1 Aug. 17, 2006

Related U.S. Application Data

(60) Provisional application No. 60/653,001, filed on Feb. 15, 2005.

(51) Int. Cl.

| | |
|---|---|
| ***B21D 5/16*** | (2006.01) |
| ***B21D 39/02*** | (2006.01) |
| *B21D 19/08* | (2006.01) |
| *B21J 9/18* | (2006.01) |

(52) U.S. Cl. ..... 72/306; 72/316; 72/323; 72/451; 72/450; 29/243.58

(58) Field of Classification Search ..... 72/384, 72/306, 316, 323, 386, 451; 29/243.58, 243.57, 29/243.5

See application file for complete search history.

(56) References Cited

U.S. PATENT DOCUMENTS

| | | | | |
|---|---|---|---|---|
| 5,005,398 | A * | 4/1991 | Evans | 72/450 |
| 5,454,261 | A * | 10/1995 | Campian | 72/384 |
| 6,474,125 | B1 * | 11/2002 | Denis et al. | 72/306 |
| 6,739,168 | B1 * | 5/2004 | Hario et al. | 72/323 |
| 6,745,608 | B1 * | 6/2004 | Miura | 72/306 |

* cited by examiner

*Primary Examiner*—David B. Jones
(74) *Attorney, Agent, or Firm*—Fildes & Outland, P.C.

(57) ABSTRACT

A pre-hemming apparatus for use with a hemming die includes a driving member adapted to be centrally disposed below the hemming die. A plurality of link arms are operatively, pivotally connected to the driving member. A lever arm is operatively connected to each link arm. A flanging member is operatively connected to each lever arm at an end thereof. A plurality of mounts for supporting the lever arms are adapted to be mounted to a side of the hemming die. Each lever arm is pivotally connected to one of the mounts intermediate ends of the lever arm. An actuator is operatively engagable with the driving member. Actuation of the driving member moves the flanging members towards the hemming die through the lever arms and the link arms for pre-hemming, and away from the hemming die cycling the apparatus.

15 Claims, 4 Drawing Sheets

FIG - 3A
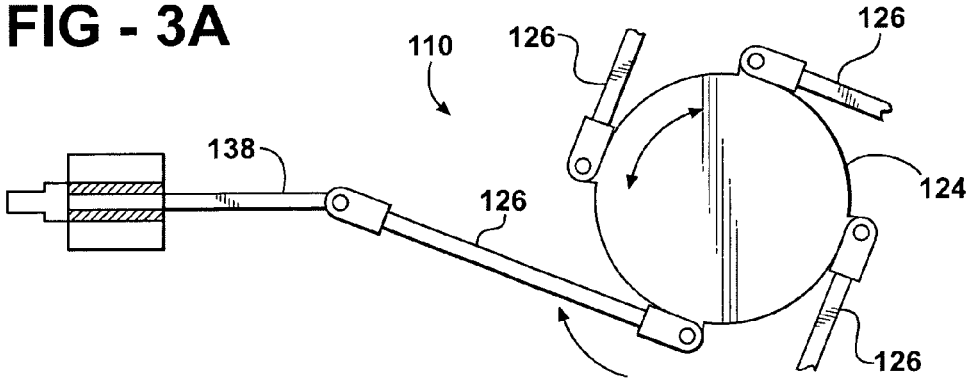
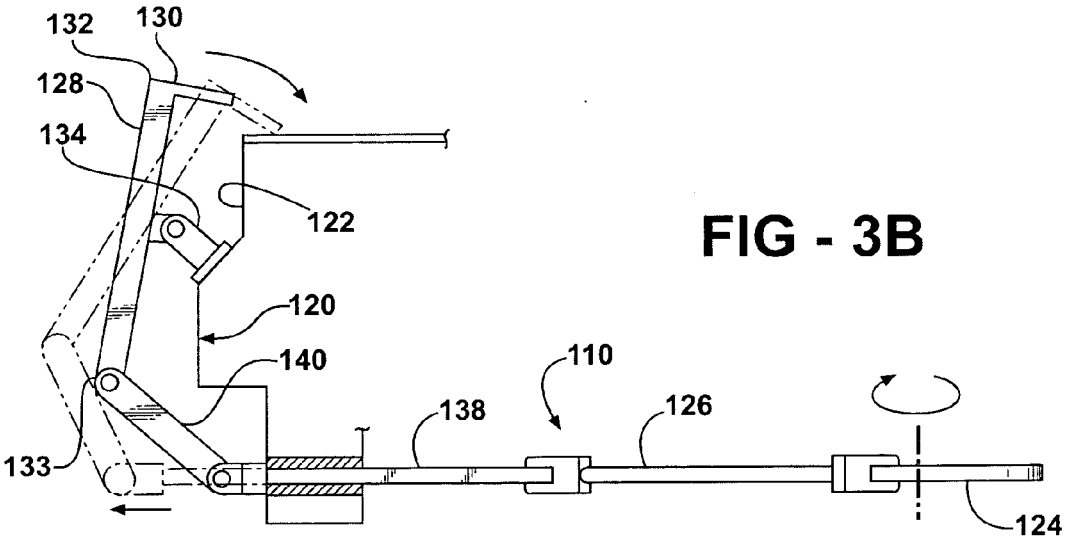
FIG - 3B
FIG - 4
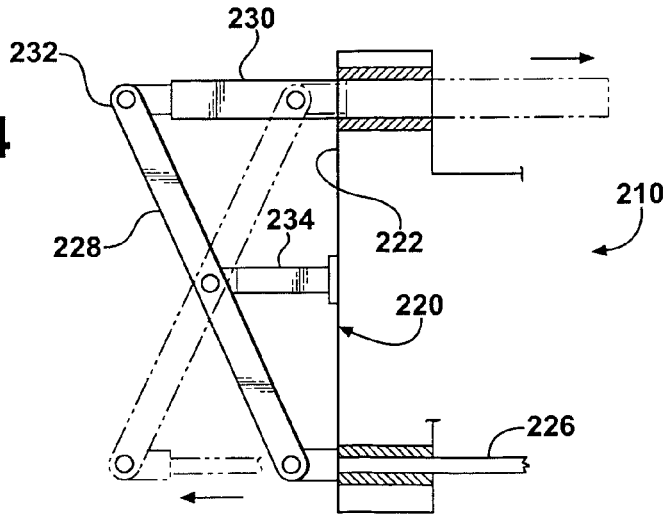

PRE-HEMMING APPARATUS

CROSS REFERENCE TO RELATED APPLICATION

This application claims the priority of U.S. Provisional Application No. 60/653,001 filed Feb. 15, 2005.

TECHNICAL FIELD

This invention relates to robotic roller hemming and more particularly, to pre-hemming of closure panels such as vehicle door, hood, and decklid panels.

BACKGROUND OF THE INVENTION

It is known in the art relating to robotic roller hemming to pre-hem sheet metal fabricated parts, such as vehicle closure panels or other similar workpieces, to a pre-hem condition prior to the hemming of the closure panels. A vehicle closure panel may consist of an outer panel and an inner panel, which are hemmed together in a hemming process. In the hemming process, it is known to pre-hem the outer corners of a closure panel, for example by bending the corners of the outer panel towards the inner panel. Known methods for pre-hemming closure panels utilize robotic roller hemmers to hem the corners of the outer panel over the inner panel. These methods, however, require several passes with the hem roller and therefore require a significant amount of time. Further, use of a robotic roller hemmer does not always lead to a quality corner pre-hem, as the hem roller does not have the shape required to accurately make a corner pre-hem. The hem roller is therefore often ineffective for corner pre-hem operations.

SUMMARY OF THE INVENTION

The present invention provides a pre-hemming apparatus that includes a mechanical link system for actuation of corner pre-hem flanging members. Mechanical link arms disposed under a hem die are connected to a central driving member, and lever arms operatively connected to the link arms drive the flanging members. The pre-hemming apparatus is actuated through the driving member. Since the pre-hemming apparatus is actuated from underneath the hemming die, the apparatus does not interfere with robotic roller hemming processes. Further, the link arms, being operatively connected to the driving member, allow all of the flanging members to be driven simultaneously. This advantageously provides for corner pre-hemming of multiple corners of a workpiece at one time.

The present invention also does not require the use of a robot arm, such as in methods utilizing a robotic roller hemmer, thereby increasing the overall speed of the hemming process. For instance, the present invention may save several seconds per each pre-hem operation on a corner of a closure member, thereby leading to decreased cycle times. Furthermore, since the flanging members may be designed to have the required shape to effect a corner pre-hem (e.g., shaped to cooperate with a corner of a closure panel), the present invention is able to achieve a higher quality and more consistent corner pre-hem.

More particularly, a pre-hemming apparatus in accordance with the present invention for use with a hemming die includes a driving member adapted to be centrally disposed below the hemming die. A plurality of link arms are operatively, pivotally connected to the driving member. A lever arm is operatively connected to each link arm. A flanging member is operatively connected to each lever arm at an end thereof. A plurality of mounts for supporting the lever arms are adapted to be mounted to a side of the hemming die. Each lever arm is pivotally connected to one of the mounts intermediate the ends of the lever arm. An actuator is operatively engagable with the driving member. Actuation of the driving member moves the flanging members towards the hemming die through the lever arms and the link arms for pre-hemming, and away from the hemming die cycling the apparatus.

In one embodiment, the driving member may be a cam plate. At least one additional link member may be operatively, pivotally connected between each of the link arm and lever arm pairs. The flanging members may be mounted on the lever arms and may be flanging steels. The actuator may be an air cylinder. Four lever arms may be disposed at corners of the hemming die.

Alternatively, the driving member may be a link bar and the actuator may be a piston or a robot arm. Further, the flanging members may be pivotally connected to the lever arms.

In another embodiment, a pre-hemming assembly in accordance with the present invention includes a hemming apparatus. The hemming apparatus includes a base, a rotatable turntable mounted on the base, a mounting bracket disposed on the turntable, and a hemming die mounted on the mounting bracket. The arrangement further includes a driving member centrally disposed below the hemming die. A plurality of link arms are operatively, pivotally connected to the driving member. A lever arm is operatively connected to each link arm. A flanging member is operatively connected to each lever arm at an end thereof. The system further includes a plurality of mounts for supporting the lever arms. Each of the mounts is mounted to a side of the hemming die, and each lever arm is pivotally connected to one of the mounts intermediate the ends of the lever arm. An actuator is operatively engagable with the driving member and is mounted on the mounting bracket below the hemming die. Actuation of the driving member moves the flanging members towards the hemming die through the lever arms and the link arms for pre-hemming, and away from the hemming die cycling the apparatus.

Optionally, the actuator may be one of an air cylinder, a piston, and a robot arm. The driving member may be one of a rotary cam plate and a link bar. The flanging members may be flanging steels.

These and other features and advantages of the invention will be more fully understood from the following detailed description of the invention taken together with the accompanying drawings.

BRIEF DESCRIPTION OF THE DRAWINGS

In the drawings:

FIG. 3A is a schematic illustration of force and motion of a linkage of an alternative embodiment of a pre-hemming apparatus in accordance with the present invention;

FIG. 3B is a schematic illustration of force and motion of the linkage of FIG. 3A;

FIG. 4 is a schematic illustration of force and motion of a linkage of another alternative embodiment of a pre-hemming apparatus in accordance with the present invention;

DETAILED DESCRIPTION OF THE INVENTION

Figure 1:
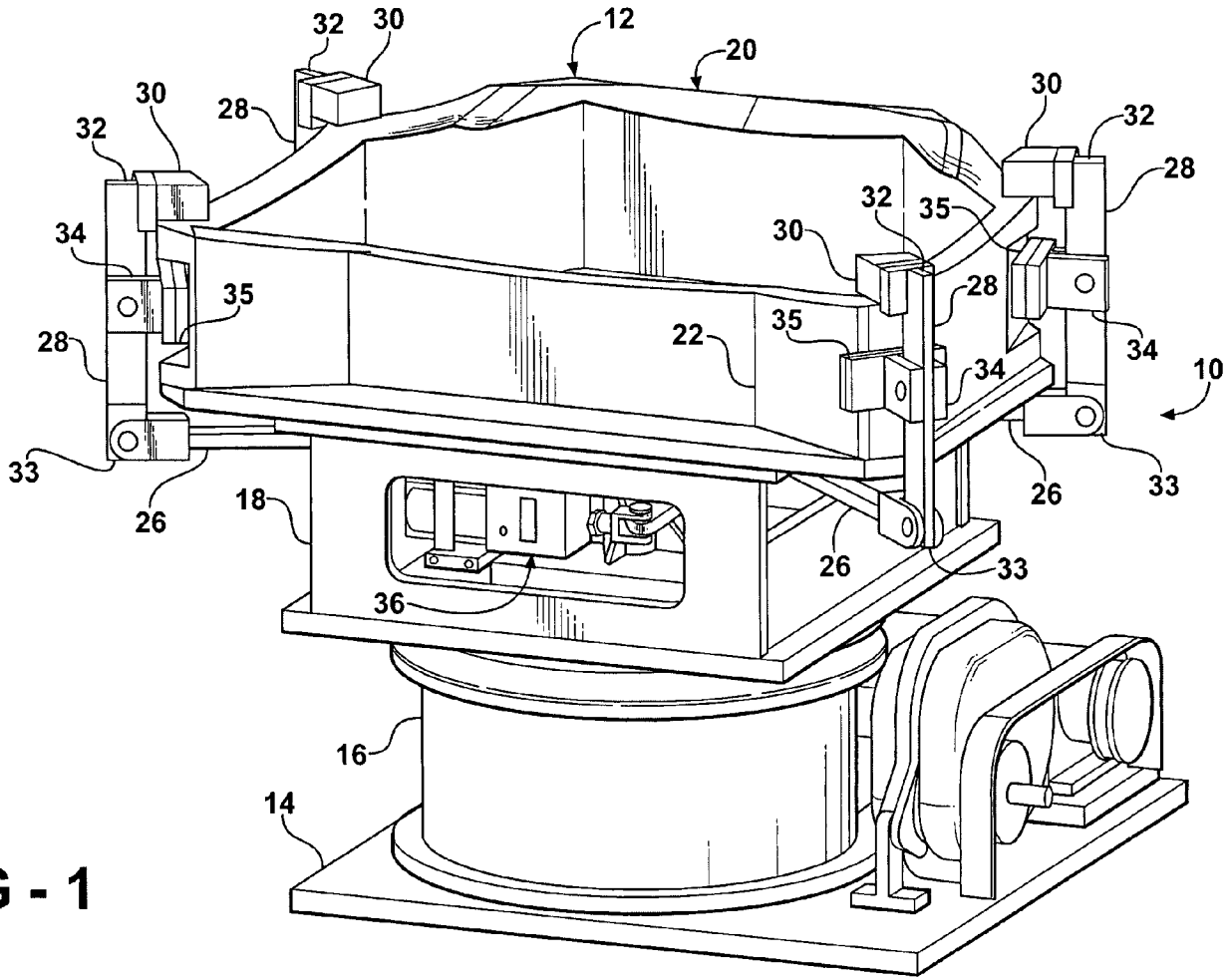
FIG. 1 is a perspective view of a pre-hemming apparatus in accordance with the present invention disposed about and mounted to a hemming die turntable apparatus.

Referring now to the drawings in detail, numeral 10 generally indicates a pre-hemming apparatus in accordance with the present invention. The pre-hemming apparatus provides for pre-hemming of multiple corners of a workpiece at one time, resulting in a decrease in hemming cycle time. The pre-hemming apparatus also may be primarily disposed underneath a hemming die, thereby decreasing interference with other hemming operations that are performed from above the hemming die.

Figure 2:
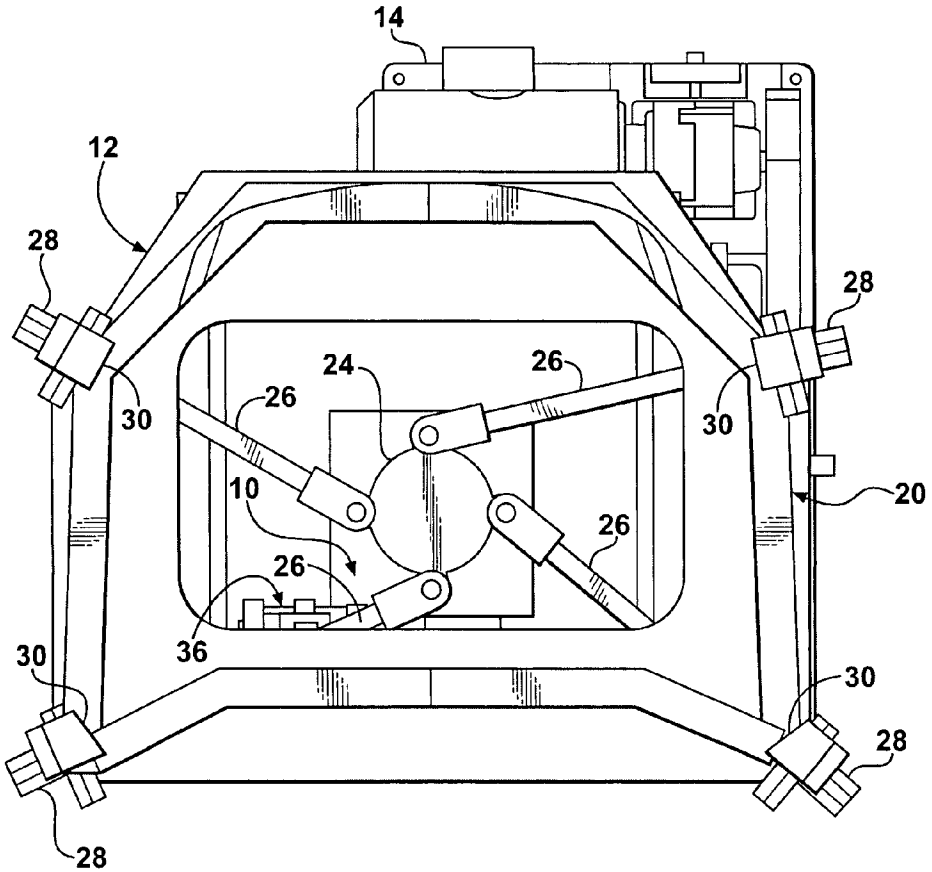
FIG. 2 is a plan view of the pre-hemming apparatus and hemming die turntable apparatus arrangement of FIG. 1.

FIGS. 1 and 2 illustrate a first embodiment of a pre-hemming apparatus 10 in accordance with the present invention. The pre-hemming apparatus 10 is useable in connection with a hemming die apparatus 12 such as a hem die turntable apparatus or similar. For example, as shown in FIGS. 1 and 2, the hem die turntable apparatus 12 may be of the type that includes a base 14, a motorized turntable 16 mounted on the base 14, a mounting bracket 18 disposed on the turntable 16, and a hemming die 20 mounted on the mounting bracket 18. The hemming die 20 may support a workpiece (not shown) to be hemmed. It should be understood, however, that the pre-hemming apparatus 10 may be used with any hemming apparatus having a hem die elevated by a mounting table, mounting bracket, or other similar raised mounting member.

In the first embodiment of the pre-hemming apparatus 10, the pre-hemming apparatus includes a driving member 24 centrally disposed below the hemming die 20. In this embodiment, the driving member 24 is a crank such as a cam plate or similar. A plurality of link arms 26 are operatively, pivotally connected to the driving member 24. A lever arm 28 is operatively connected to each link arm 26. A flanging member 30, such as a flanging steel or similar, is mounted on each lever arm 28 at an end 32 thereof. The flanging members 30 may be designed such that an outer portion of the flanging member has a shape required to effect a corner pre-hem. A plurality of mounts 34 for supporting the lever arms 28 are mounted to a side surface 22 (e.g., a sidewall) of the hemming die 20. The mounts 34 may be attached to the sidewall 22 via plates 35. Each lever arm 28 is pivotally connected to one of the mounts 34 intermediate the ends 32, 33 of the lever arm 28. This allows each lever arm 28 to pivot about a point intermediate the ends 32, 33 of the lever arm. The mounts 34 may be clevises, shackles, or similar mounting device that may pivotally support the lever arms 28. An actuator 36, such as an air cylinder or similar, is operatively engagable with the driving member 24. Actuation of the driving member 24 pivots the flanging members 30 towards the hemming die 20 through the lever arms 28 and the link arms 26 for pre-hemming, and away from the hemming die 20 cycling the apparatus.

In the embodiment of the pre-hemming apparatus 10 shown in FIGS. 1 and 2, the actuator 36 may be mounted on the mounting bracket 18 of the hem die turntable apparatus 12 below the hemming die 20. The driving member 24 may also be supported by the mounting bracket 18. The driving member 24 is thereby disposed below the hemming die 20. Further, in this embodiment, the pre-hemming apparatus 10 includes four link arms 26 operatively, pivotally connected to the driving member 24 in a generally evenly spaced relationship. The four link arms 26, being operatively, pivotally connected to the driving member 24, are also disposed below the hemming die 20. Therefore, the linkage and actuation of the pre-hemming apparatus 10 occurs from underneath the hemming die 20 and does not interfere with operations that are performed on workpieces that are placed on the hemming die 20. A lever arm 28 is operatively, pivotally connected to each of the four link arms 26, such that this embodiment also includes four lever arms 28. The lever arms 28 are disposed at corners of the hemming die 20 for pre-hemming corners of a workpiece, such as a closure panel, placed on the hemming die 20.

Specifically, a closure panel (not shown) including an inner panel and an outer panel may be placed on the hemming die 20 of the hemming apparatus 12. For instance, an outer sheet metal fabricated part panel may be first placed on the hemming die 20. Next, an inner sheet metal fabricated part panel may be placed onto the outer panel. A holding device, pad, or similar may then be used to apply pressure on the inner and outer panels to insure that the panels do not move and are properly located.

To begin the corner pre-hem operation, the air cylinder 36 is actuated so that the cylinder begins a stroke. The air cylinder 36, being operatively engaged with the driving member 24, causes the driving member to rotate in a clockwise direction. Clockwise rotation of the driving member 24 moves the link arms 26 outwardly away from the hemming die 20. The movement of the link arms 26 causes the lever arms 28 to pivot about the mounts 34 via the pivotal linkage of the link arms 26 and lever arms 28. Pivoting of the lever arms 28 moves the flanging members 30 mounted to the lever arms 28 from a rest position to a work position. In the work position, the flanging members 30 apply a force to the corners of the outer panel to pre-hem the outer panel towards the inner panel. The portion of each flanging member 30 that contacts a corner of the outer panel may be configured to pre-hem the outer panel to a required shape. All of the flanging members 30 are driven simultaneously by a single stroke of the air cylinder 36, thereby pre-hemming the outer corners of the closure panel in a single operation. This results in a significant saving of time.

After the flanging members 30 have pre-hemmed the closure panel, the air cylinder 36 goes through a retraction stroke. This causes the driving member 24 to rotate counter-clockwise back towards its resting position, thereby drawing the link arms 26 inward towards the hemming die 20 and causing the lever arms 28 to move from the work position to the rest position, completing a cycle. Thereafter, the closure panel may be hemmed, such as with a robotic roller hemmer.

Optionally, as shown in FIGS. 3A and 3B, a pre-hemming apparatus 110 in accordance with the present invention may include at least one additional link member 138 operatively, pivotally connected between each of the link arm 126 and lever arm 128 pairs. In the embodiment of FIGS. 3A and 3B, the pre-hemming apparatus 110 includes two additional link members 138, 140 between each link arm 126 and lever arm 128. The pre-hemming apparatus 110 otherwise has features similar to the first embodiment.

FIGS. 3A and 3B schematically illustrate the motion of the linkage of the pre-hemming apparatus 110, which is similar to the motion described in relation to the first embodiment. Clockwise rotation of the driving member 124 causes the link arms 126 to be generally pushed away from the central linkage member 124. The motion of the link arms 126 push the first additional link arms 138 outward, which in turn push and pivot the second additional link arms 140 outward and upward. The outward and upward motion of the second additional link arms 140 pivot the lever arms 128 from a rest position to a work position, moving the flanging members 130 towards the hemming die 120 for pre-hemming a corner of a workpiece. Counter-clockwise rotation of the driving member 124 reverses these motions to complete a cycle.

FIG. 4 illustrates a third embodiment of the present invention. In this embodiment, the flanging member 230 of the pre-hemming apparatus 210 is pivotally connected to an end 232 of the lever arm 228. The pre-hemming apparatus 210 otherwise has features similar to the first embodiment. The outward motion of the link arm 226 away from the hemming die 220 causes the lever arm 228 to pivot about the mount 234. Pivoting of the lever arm 228 pushes the flanging member 230 inward, causing the flanging member 230 to pre-hem a workpiece (not shown) disposed on the hemming die 220.

Figure 5:
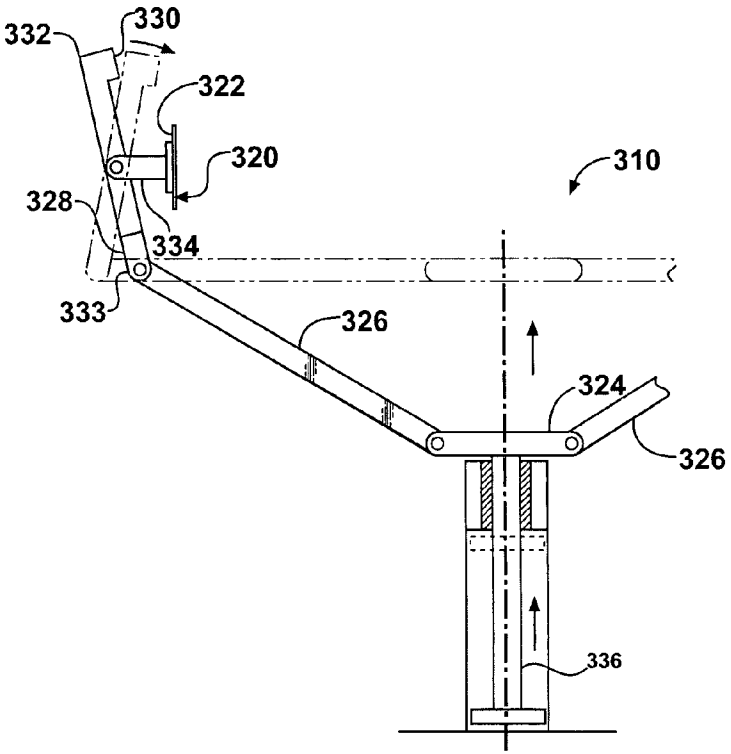
FIG. 5 is a schematic illustration of force and motion of a linkage of another alternative embodiment of a pre-hemming apparatus in accordance with the present invention.

FIG. 5 illustrates yet another embodiment of the present invention. In this embodiment of a pre-hemming apparatus 310, the driving member 324 is a link bar or similar. A plurality of link arms 326 are operatively, pivotally connected to the link bar 324. A lever arm 328 is operatively, pivotally connected to each link arm 326 at one of its ends 333. A flanging member 330 is mounted to each lever arm 328 at an end 332 opposite the pivotal connection to the link arm 326. Each lever arm 328 is supported by a mount 334 that is itself mounted to a side 322 of the hemming die 320. Each lever arm 328 pivots about the mount 334 intermediate its ends 332, 333. Further, in this embodiment, the actuator 336 is a piston or similar device. Upward motion of the piston 336 pushes the link bar 324 upwards, thereby pivoting the link arms 326, which in turn move the lever arms 328 into a work position to perform a corner pre-hem operation. Downward motion of the piston 336 move the lever arms 238 back to a rest position, completing a cycle of the apparatus 310.

Figure 6:
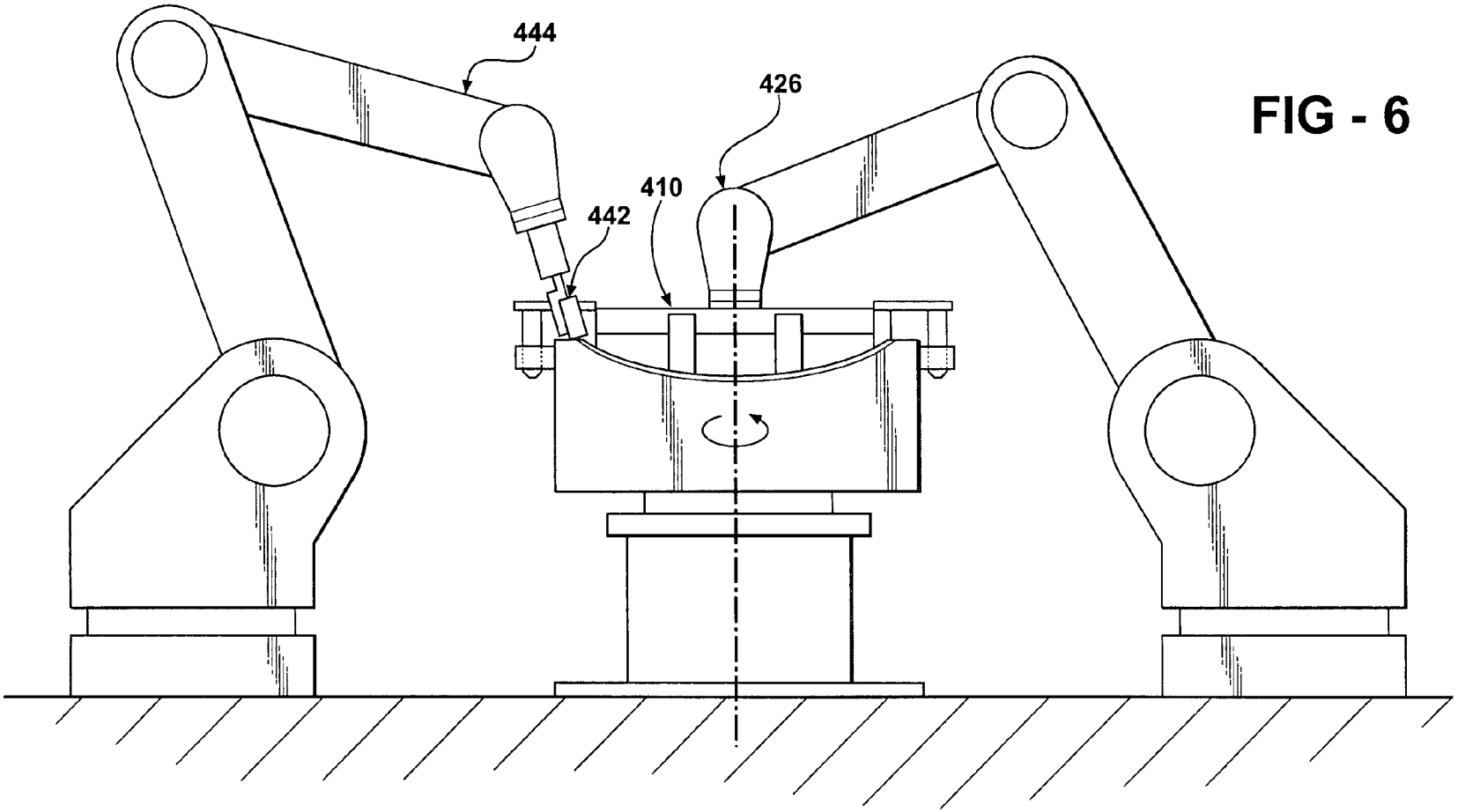
FIG. 6 is an environmental view of another alternative embodiment of a pre-hemming apparatus in accordance with the present invention illustrating actuation of the pre-hemming apparatus by a robot arm.

FIG. 6 illustrates a fifth embodiment of a pre-hemming apparatus 410 in accordance with the present invention. In this embodiment, the apparatus 410 is actuated by a robot arm 426. For example, the robot arm 426 may actuate the apparatus 410 by turning a driving member (not shown) similar to the cam plate in the first embodiment. As further shown in FIG. 6, a hem roller 442 may be attached to another robot arm 444 for roller hemming a workpiece after the workpiece has been pre-hemmed by the pre-hemming apparatus 410.

Although the invention has been described by reference to specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. A pre-hemming apparatus for use with a hemming die, the pre-hemming apparatus comprising:

a driving member adapted to be centrally disposed below said hemming die;

a plurality of link arms operatively, pivotally connected to said driving member;

a lever arm operatively connected to each link arm;

a flanging member operatively connected to each lever arm at an end thereof;

a plurality of mounts for supporting said lever arms, each of said mounts adapted to be mounted to a side of said hemming die, and each lever arm being pivotally connected to one of said mounts intermediate ends of said lever arm; and an actuator operatively engagable with said driving member, whereby actuation of said driving member moves said flanging members towards said hemming die through said lever arms and said link arms for pre-hemming, and away from said hemming die cycling the apparatus.

2. The pre-hemming apparatus of claim 1, wherein said driving member is a cam plate.

3. The pre-hemming apparatus of claim 1, wherein at least one additional link member is operatively, pivotally connected between each of said link arm and lever arm pair.

4. The pre-hemming apparatus of claim 1, wherein each of said flanging members is mounted on one of said lever arms.

5. The pre-hemming apparatus of claim 1, wherein each of said flanging members is pivotally connected to one of said lever arms.

6. The pre-hemming apparatus of claim 1, wherein said flanging members are flanging steels.

7. The pre-hemming apparatus of claim 1, wherein said actuator is an air cylinder.

8. The pre-hemming apparatus of claim 1, including lever arms disposed at corners of the hemming die.

9. The pre-hemming apparatus of claim 1, wherein said driving member is a link bar.

10. The pre-hemming apparatus of claim 1, wherein said actuator is a piston.

11. The pre-hemming apparatus of claim 1, wherein said actuator is a robot arm.

12. A pre-hemming assembly comprising:

a hemming apparatus including a base, a rotatable turntable mounted on the base, a mounting bracket disposed on the turntable, and a hemming die mounted on the mounting bracket;

a driving member centrally disposed below said hemming die;

a plurality of link arms operatively, pivotally connected to the linkage member;

a lever arm operatively connected to each link arm;

a flanging member operatively connected to each lever arm at an end thereof;

a plurality of mounts for supporting said lever arms, each of said mounts being mounted to a side of said hemming die, and each lever arm being pivotally connected to one of said mounts intermediate the ends of said lever arm; and an actuator operatively engagable with said driving member, said actuator being mounted on said mounting bracket below said hemming die;

whereby actuation of said driving member moves said flanging members towards said hemming die through said lever arms and said link arms for pre-hemming, and away from said hemming die cycling the apparatus.

13. The pre-hemming assembly of claim 12, wherein said actuator is one of an air cylinder, a piston, and a robot arm.

14. The pre-hemming assembly of claim 12, wherein said driving member is one of a rotary cam plate and a link bar.

15. The pre-hemming assembly of claim 12, wherein said flanging members are flanging steels.

* * * * *